United States Patent [19]

Kopp et al.

[11] Patent Number: 4,460,266

[45] Date of Patent: Jul. 17, 1984

[54] DEVELOPING DEVICE FOR DEVELOPING CHARGE IMAGES ON A CHARGE IMAGE CARRIER

[75] Inventors: Walter Kopp, Taufkirchen; Karl-Heinz Saalmuller, Munich, both of Fed. Rep. of Germany

[73] Assignee: Siemens Aktiengesellschaft, Berlin & Munich, Fed. Rep. of Germany

[21] Appl. No.: 369,833

[22] Filed: Apr. 19, 1982

[30] Foreign Application Priority Data

Apr. 30, 1981 [DE] Fed. Rep. of Germany ..... 3117238

[51] Int. Cl.[3] ..... G03G 15/00

[52] U.S. Cl. ..... 355/3 DD; 355/14 D; 118/658; 118/657

[58] Field of Search ..... 118/658; 355/14 D, 3 DD

[56] References Cited

U.S. PATENT DOCUMENTS

| | | | |
|---|---|---|---|
| 3,784,297 | 1/1974 | Ito et al. . | |
| 3,883,240 | 5/1975 | Ito et al. . | |
| 4,324,483 | 4/1982 | Tayawa et al. | 355/3 DD |
| 4,331,100 | 5/1982 | Mochizuki et al. | 118/657 |
| 4,378,753 | 4/1983 | Ueno et al. | 118/657 |

*Primary Examiner*—J. V. Truhe
*Assistant Examiner*—David Warren

[57] ABSTRACT

In a developer station for an electrophotographic printing or copying machine, there is provided a developer drum apparatus for producing optimum inking density and resolution of the charge images being passed through the developer station on a charge image carrier. The apparatus comprises a rotating hollow cylinder within which is contained a stationary magnet arrangement in the form of a series of rows of permanent magnets, each row being disposed longitudinally with the cylinder, supported on a stator carrier. The first row of magnets is disposed adjacent the lower end of the cylinder for attracting developer mix particles from the floor of the developer station housing and the succeeding rows of magnets are disposed along the transport path of particles on the cylinder to promote transport of the mix upwardly on the cylinder to an inking gap area with the charge image carrier. A final row of relatively wider magnets is disposed at the upper end of the cylinder with its longitudinal centerline substantially offset from the inking gap to promote uniform distribution of the mix along the length of the cylinder just prior to inking. The layer amount of developer mix carried by the rotating cylinder is set by an adjustable doctoring strip disposed beneath the first magnet row and a narrow transport channel defined between the cylinder and a housing wall along the mix transport path.

10 Claims, 2 Drawing Figures

DEVELOPING DEVICE FOR DEVELOPING CHARGE IMAGES ON A CHARGE IMAGE CARRIER

RELATED APPLICATIONS

This application concerns subject matter which relates to the following commonly assigned U.S. patent applications, all filed Apr. 19, 1982:

Ser. No. 369,832 entitled "Mixing Device for Blending a Developer Consisting of Carrier Particles and Toner", Ser. No. 369,834 entitled "Developing Station for Developing Charge Images on a Charge Image Carrier", and Ser. No. 369,897 entitled "Device for Removing the Developer Mix from a Developing Station".

BACKGROUND OF THE INVENTION

The invention relates to developer drum apparatus for use in an electrophotographic printing or copying machine developer station for developing charge images on a charge image carrier with the use of developer mix particles consisting of toner and iron carrier powders.

Typically, non-mechanical printing or copying machines function according to electrophotographic principles, wherein electrostatic latent images of characters to be printed are generated on a recording medium, such as a photoconductive drum. The drum has on it a semiconductor layer of photo-electrical or di-electrical material on while electrostatic charge images of the characters to be printed or copied are generated. These electrostatic images are subsequently inked with a toner powder in a developer station. The toner images are subsequently transferred to sheet paper on which they are fixed. The developer station typically includes at least one developer unit generally referred to in the art as a magnetic brush developer. The magnetic brush developer, as a rule, contains a magnetic brush or drum, otherwise referred to as the developer drum, mounted for rotation so as to continually bring developer mix, consisting of iron carrier particles and a toner, typically a black powder particles, into contact with the electrostatic images recorded on the photoconductive drum surface. The charge images are inked by adherence of toner particles to the charge images, due to electrostatic forces. The general principles of a developer station construction are known in the art as shown, for example, in U.S. Pat. Nos. 3,784,297 and 3,883,240. The typical developer drum comprises a rotating hollow cylinder and a stationary magnet arrangement disposed interiorly of the hollow cylinder. The individual magnets of the magnet arrangement are secured to a stationary support. The magnets are arranged within the hollow cylinder so as to alternate in polarity in the direction of motion of the cylinder and thus cause the transport of developer mix particles on the outer surface of the cylinder from a supply area within the developer station housing to an engagement area with the charge image carrier.

Especially with respect to high-speed copying and printing machines, there is a problem with uniformly developing the charge images over the entire width of the charge image carrier with consistent density over a period of time and high resolution. An object of the present invention is to provide a developer drum construction by which charge images on the charge image carrier can be uniformly developed along the width of the carrier while maintaining a consistent density in the developed images and high resolution.

SUMMARY OF THE INVENTION

A developer drum construction for use in the developer station of an electrophotographic printing or copying machine comprises a hollow cylinder mounted for rotation within the developer station housing and a magnet arrangement having a series of parallel rows of permanent magnets arranged behind one another on a stationary support carrier disposed within the rotating cylinder. The rows of magnets are longitudinal with the axis of rotation of the cylinder and are arranged along part of the circumference of the cylinder. The first row of permanent magnets is disposed within the lower end of the cylinder adjacent the floor of the developer station which carries a body of developer mix particles. Upwardly from the first row of magnets there is provided across from the following rows of magnets a transport channel for developer mix particles formed between the hollow cylinder wall and a substantially concentrically shaped housing wall of the developer station. The final row of permanent magnets is disposed adjacent the upper end of the hollow cylinder with its longitudinal centerline offset by a predetermined angle from an inking nip formed between the cylinder and the moving surface of the charge image carrier. It is at the inking nip where the charge images contained on the carrier are developed by the adherence of the toner particles.

Particularly uniform developing of the charge images is brought about in that the final row of permanent magnets is formed with a greater width dimension relative to the remaining rows of magnets. Preferably, the final row of magnets is of a width twice that of the other rows of magnets. The final row of magnets primarily serves the purpose of arranging the developer mix particles conducted by the rotating cylinder for development of the charge images; whereas the remaining rows of magnets leading to the final row cause the developer mix particles to be carried upwardly from the developer housing floor to the development area on the exterior surface of the hollow cylinder.

Further in accordance with the invention, the permanent magnets of each row are disposed along a continuous, common plate made of soft iron material which is secured to the support carrier. This arrangement serves to achieve a uniform magnetic field along each row of permanent magnets, each row being disposed substantially the full length of the developer cylinder.

In accordance with the preferred embodiment construction, the angle between the inking nip and the longitudinal centerline of the final row of magnets is substantially 25°. This angle placement of the final row of magnets brings about a particularly homogeneous distribution of developer on the charge image carrier along the full width of the inking nip. Further, in order to afford a layer of developer mix particles of even level or thickness carried by the developer drum, there is provided a rotatably adjustable semicircular shaft adjacent the lower end of the rotating cylinder drum to act as a leveling strip or doctor to the feed flow of mix into the developer transport channel. The leveling strip substantially underlies the first row of permanent magnets.

DESCRIPTION OF THE PREFERRED EMBODIMENT

Figure 1:
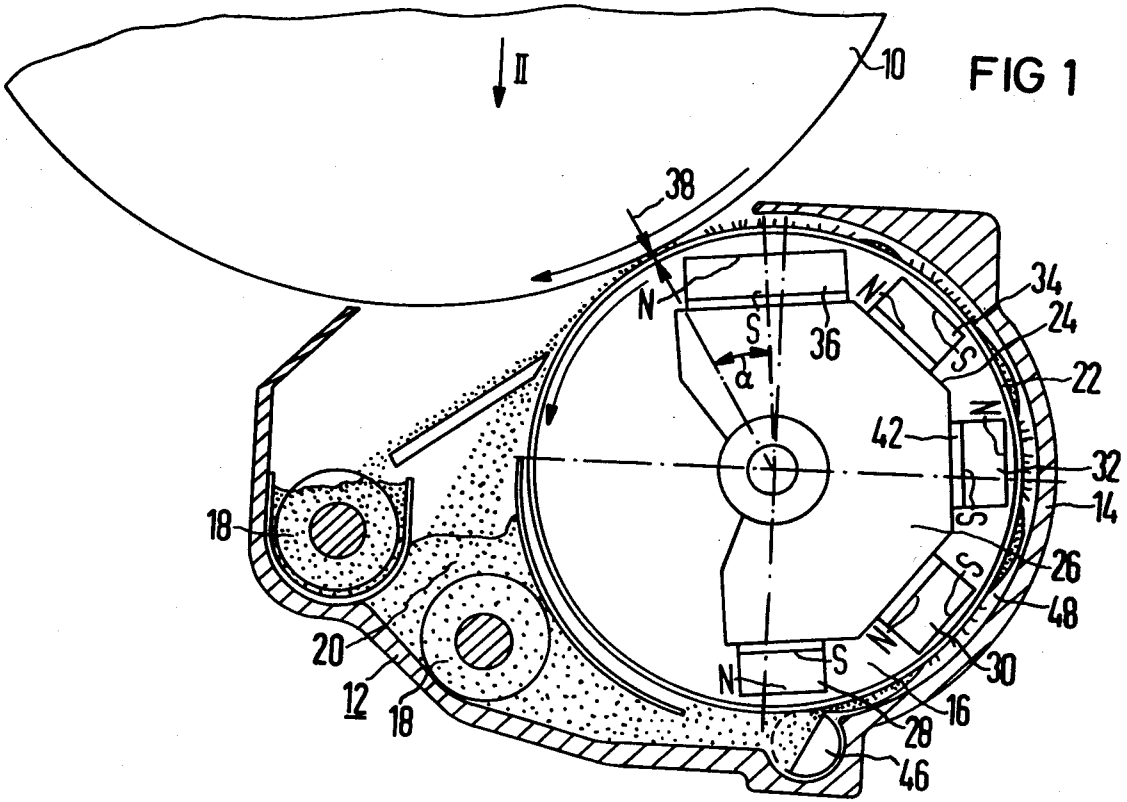
FIG. 1 is a schematic, side elevational cross-sectional view of a developer station having developer drum apparatus in accordance with the present invention.

FIG. 1 illustrates a developer station 12 for use in an electrophotographic printing or copying machine. A charge image carrier in the form of a photoconductive drum 10 is mounted for rotation in the machine in the direction indicated by the arrow for conducting charge images from suitable charging stations (not shown) to the developer station 12 for inking, and then to suitable transfer and cleaning stations (not shown). The developer station housing is formed with a floor surface on which is disposed a body 20 of developer mix particles consisting of toner and finally divided iron carrier particles. The developer station housing may also contain rotary screw means 18 for continual mixing of the toner and carrier particles in the main body mix and for replenishing the supply of toner in the mix 20.

A developer drum arrangement 16 is disposed within the developer station housing for conducting developer mix particles from the main body 20 to and past the charge image carrier 10 for the development or inking of the charge images contained on the carrier surface. The developer drum arrangement comprises a hollow cylinder 22, which may be made of aluminum and have an exterior milled surface, suitably mounted for rotation. A magnet arrangement 24 is fixed within the interior of the cylinder 22. The magnet arrangement 24 comprises a magnet stator 26 which serves as a support carrier for a series of rows 28, 30, 32, 34, and 36 of individual permanent magnets disposed longitudinally with the axis of rotation of the cylinder. As indicated by the N and S designations shown in FIG. 1, the magnet rows 28, 30, 32, 34, and 36 have consecutively alternating polarity which provides a closed magnetic field line progressing along slightly more than half of the circumference of the cylinder 22.

As the hollow cylinder 22 rotates, iron carrier particles with toner particles adhering thereto in the known manner as a result of electrostatic forces migrate along the magnetic field line on the exterior surface of the cylinder 22 in the direction of rotation of the cylinder. A portion of developer mix is thus taken from the main body 20 under the influence of the lead row 28 of permanent magnets disposed adjacent the lower end of the cylinder 22 from a pick up zone defined thereby and transported to the surface of the charge image carrier 10 under the magnetic influence of the succeeding magnet rows 30, 32, and 34.

The final row of magnets 36 is disposed adjacent the upper end of the rotating cylinder 22 immediately in front of an inking gap formed between the cylinder 22 and the charge image carrier 10 for affecting the inking development of the charge images. This row 36 of permanent magnets is preferably formed of a width twice that of the remaining rows of magnets. The magnets in this final row may be one piece elements or the row may be made up of a longitudinal series of double magnets. By virtue of this arrangement of the final row 36 of magnets, there is provided a homogeneous, uniform magnetic zone immediately preceding the inking gap 38, whereby developer mix particles are uniformly distributed over the surface of the cylinder 22 and, subsequently, conveyed through the inking gap 38. The magnet row 36 is positioned to produce an optimum inking of the charge images. Preferably, the longitudinal centerline of the magnet row 36 is disposed at an angle $\alpha$ from the narrowmost point in the inking gap 38 amounting to approximately 25°. By virtue of the relatively enlarged width of the magnet row 36, developer mix on the surface of the cylinder 22 is permitted increased travel time on the cylinder to distribute into an even, dense formation. Further, the disposition of the magnet row 36 offset by an angle of approximately 25° relative to the inking gap 38 produces an optimum level of inking quality since the more uniform distribution of the developer particles eliminates the heretofore need to ink charge images directly against the developed drum, in which cases an undesirably large number of carrier particles usually remain adhering to the charge image carrier 10. By arranging the charge image development magnet row 36 substantially offset from the inking gap 38, a relatively lower carrier discharge onto the charge image surface 10 is afforded.

Figure 2:
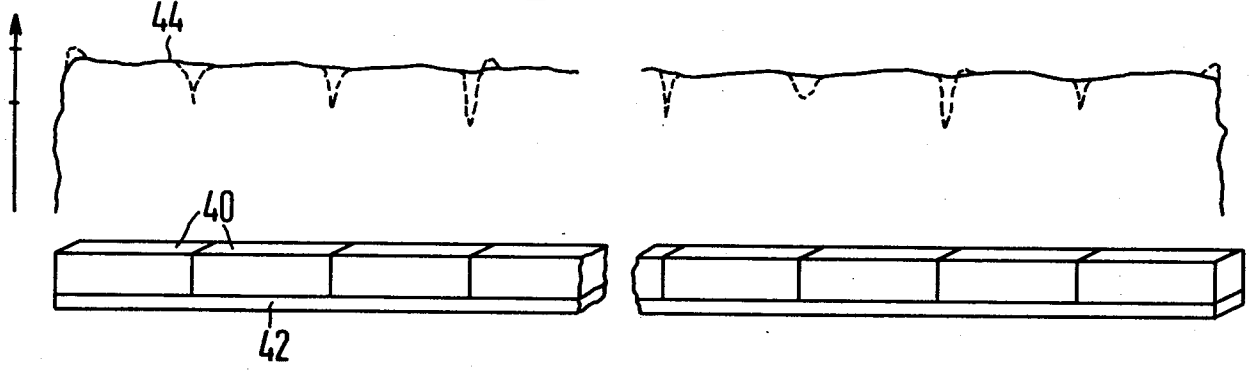
FIG. 2 is a perspective view of one row of permanent magnets arranged within the developer drum of FIG. 1 underlying a magnetic induction level vs. length diagram pertaining to the permanent magnet row.

FIG. 2 shows one such row of permanent magnets used in the inventive developer drum apparatus 16. Preferably, all of the magnet rows 28, 30, 32, 34, and 36 are constructed in the same following manner. The magnet row is made up of individual permanent magnets 40 disposed in intimate series next to one another. This arrangement presents a potential problem that the magnetic induction level will suffer a collapse at the interfaces between the individual magnets 40. In order to prevent this and promote a substantially uniform, homogeneous magnetic field along the entire row of permanent magnets, the individual magnets 40 are bonded to a continuous, common soft iron plate 42 which is seated on the support carrier 26. In this manner, the possible collapses of magnetic induction at the interfaces between the permanent magnets 40 are substantially avoided as shown by the solid line curve 44 of magnetic induction level vs. length along the row of magnets 40 displayed in FIG. 2. The collapses in the magnetic induction level without the use of the common plate 42 are shown by the broken lines along the curve of FIG. 2.

Optimum inking of the charge images is achieved in that the space between the charge image carrier 10 and the hollow cylinder 22 of the developer drum 16 is as small as possible, preferably about 1 mm, during inking and a uniform distribution of developer mix particles, affording high toner density along the full width of the charge image carrier 10, is now conveyed through the inking gap 38.

The toner concentration in the developer mix being passed to the inking gap 38 must be such that the charge images are well inked and, further, the height of the layer of developer mix particles carried through the inking gap by the hollow cylinder 22 must be such that the surface of the charge image carrier 10 is not damaged due to pinching. In order to meet these two requirements, a semi-circular or halved shaft 46 acting as a leveling or doctor strip is mounted for rotation along the floor of the developer station housing directly beneath the first row 28 of permanent magnets. The leveling strip 46 is adjustable to control the thickness layer of developer mix particles being passed onto the rotating cylinder 22 and, thus, enables the operator to set inking quality. The leveling strip 46 may be turned in order to compensate for position tolerances of the developer drum 16 relative to the strip 46 within the developer housing, as well as scatters of the magnetic induction level arising from the magnet row 28 which further influences the amount of developer mix being transported by the rotating cylinder. Rotation of the leveling strip 46 varies the between the strip and the adjacent circumference of the cylinder 22 for controlling the layer thickness of developer mix particles passing onto the cylinder.

Since toner can release from the carrier particles during transport of the developer mix on the rotating cylinder 22 and become deposited on adjacent stationary walls, there is the danger that toner accumulations will build up in the developer station at points along the transport path of the mix on the rotating cylinder 22. These toner accumulations could periodically break off during rotation of the cylinder causing uneven toner concentrations to pass to the inking gap 38 and thus cause the image carrier 10 to be inked with varying density or black spots. Accordingly, a housing wall 14 of the developer station 12 is provided to extend substantially concentric about the transport path of developer mix particles on the rotating cylinder 22 so as to define a transport channel 48 between the housing wall 14 and the adjacent circumference of the cylinder 22 which causes the moving developer mix to always lightly brush against the wall 14 and thus prevent toner build-up accumulations. The gap width of the transport channel 48 is selected such that the housing wall 14 is relatively closely spaced from the circumference of the cylinder 22 so that substantial build-up accumulations of toner on the wall are prevented.

Although various minor modifications may be suggested by those versed in the art, it should be understood that we wish to embody within the scope of the patent warranted hereon all such modifications as reasonably and properly come within the scope of our contribution to the art.

We claim as our invention:

1. Apparatus for use in a developer station housing comprising at least one developer drum, including a rotating hollow cylinder and a stationary permanent magnet arrangement disposed inside said cylinder, for conducting developer mix of toner and carrier particles from a pile disposed on the floor of said housing to an inking gap formed between said cylinder and a charge image carrier passing through said developer station for development of the charge images, said magnet arrangement having a plurality of permanent magnet rows disposed longitudinally with said cylinder on a fixed support and in series relationship about the circumference of said cylinder between a first magnet row disposed adjacent said housing floor and a final magnet row disposed adjacent said inking gap, said final magnet row having its longitudinal centerline offset from the narrowmost point of said inking gap in a direction opposite to the rotation direction of said cylinder and being of a width substantially greater than that of any of the remaining said magnet rows, and wherein the furthermost width edge of said final magnet row in the direction of rotation of said cylinder precedes the narrowmost point of said inking gap.

2. The apparatus of claim 1, wherein the width of said final magnet row is at least twice the width of any of the remaining said magnet rows.

3. The apparatus of claim 1, wherein each said magnet is made up of a juxtaposed series of individual permanent magnets.

4. The apparatus of claim 3, wherein each said magnet row is seated on a respective continuous plate of iron material secured to said support.

5. The apparatus of claim 1, wherein each said magnet row is made up of a juxtaposed series of individual permanent magnets and each said magnet row is seated on a respective continuous plate of iron material secured to said support.

6. The apparatus of claim 1, wherein said final magnet row has its longitudinal centerline offset from the narrowmost point of said inking gap by an angle of approximately 25° taken from the axis of rotation of said cylinder.

7. The apparatus of claim 1, wherein said housing includes a wall concentric about said cylinder and magnet rows for defining a narrow channel with said cylinder through which developer mix is conducted on said cylinder to said inking gap.

8. The apparatus of claim 1, further comprising an adjustable doctor means disposed beneath said first magnet row for controlling the layer thickness of developer mix being conducted from said pile onto said cylinder.

9. The apparatus of claim 8, wherein said doctor means comprises a semicircular shaft longitudinal with said cylinder and mounted for rotation along the floor of said housing.

10. The apparatus of claim 9, wherein said housing includes a wall concentric about said cylinder and magnet rows for defining a narrow channel with said cylinder through which developer mix is conducted on said cylinder to said inking gap.

* * * * *